US010161205B2

(12) United States Patent
Lewis et al.

(10) Patent No.: US 10,161,205 B2
(45) Date of Patent: Dec. 25, 2018

(54) MITIGATING SWAB AND SURGE PISTON EFFECTS ACROSS A DRILLING MOTOR

(71) Applicant: Halliburton Energy Services, Inc., Houston, TX (US)

(72) Inventors: Derrick W. Lewis, Houston, TX (US); James R. Lovorn, Houston, TX (US); Jon T. Gosney, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 467 days.

(21) Appl. No.: 14/440,705

(22) PCT Filed: Dec. 28, 2012

(86) PCT No.: PCT/US2012/072104
§ 371 (c)(1),
(2) Date: May 5, 2015

(87) PCT Pub. No.: WO2014/105055
PCT Pub. Date: Jul. 3, 2014

(65) Prior Publication Data

US 2015/0292280 A1 Oct. 15, 2015

(51) Int. Cl.
*E21B 21/10* (2006.01)
*E21B 4/02* (2006.01)
(Continued)

(52) U.S. Cl.
CPC ..... *E21B 21/08* (2013.01); *E21B 3/00* (2013.01); *E21B 4/02* (2013.01); *E21B 21/103* (2013.01); *E21B 44/005* (2013.01); *E21B 47/06* (2013.01)

(58) Field of Classification Search
CPC ..... E21B 4/02; E21B 21/103
See application file for complete search history.

(56) References Cited

U.S. PATENT DOCUMENTS 2,865,602 A * 12/1958 Whittle ..... E21B 4/02 175/107
4,002,063 A 1/1977 Angehrn
(Continued)

FOREIGN PATENT DOCUMENTS

| | | | |
|---|---|---|---|
| RU | 55848 | U1 | 8/2006 |
| WO | 0214649 | A1 | 2/2002 |
| WO | 2003089758 | A1 | 10/2003 |

OTHER PUBLICATIONS

International Search Report and Written Opinion issued in corresponding application PCT/US2012/072104, dated Sep. 24, 2013, 17 pgs.

*Primary Examiner* — Giovanna C. Wright
(74) *Attorney, Agent, or Firm* — Chamberlain Hrdlicka

(57) ABSTRACT

A method of mitigating undesired pressure variations can include flowing fluid between wellbore sections, thereby mitigating a pressure differential due to drill string movement, and the fluid flowing between the wellbore sections via a bypass passage extending through a drilling motor. A drill string can include a drilling motor, a bypass passage in the drilling motor, a sensor, and a flow control device configured to selectively increase and decrease fluid communication between opposite ends of the drilling motor via the bypass passage, in response to an output of the sensor indicative of drill string movement. A method of mitigating undesired pressure variations in a wellbore due to drill string movement can include selectively preventing and permitting fluid communication between wellbore sections on opposite sides of a drilling motor, the fluid communication being permitted in response to detecting a threshold drill string movement.

29 Claims, 8 Drawing Sheets

(51) Int. Cl.

| | |
|---|---|
| ***E21B 21/08*** | (2006.01) |
| ***E21B 3/00*** | (2006.01) |
| ***E21B 44/00*** | (2006.01) |
| ***E21B 47/06*** | (2012.01) |

(56) References Cited

U.S. PATENT DOCUMENTS

| | | | | |
|---|---|---|---|---|
| 4,805,449 | A | 2/1989 | Das | |
| 5,297,634 | A | 3/1994 | Loughlin | |
| 5,620,056 | A | 4/1997 | Eppink | |
| 6,289,998 | B1 * | 9/2001 | Krueger | E21B 7/18 175/107 |
| 7,096,975 | B2 | 8/2006 | Aronstam et al. | |
| 7,114,579 | B2 | 10/2006 | Hutchinson | |
| 2003/0075361 | A1 | 4/2003 | Terry et al. | |
| 2005/0087367 | A1 | 4/2005 | Hutchinson | |
| 2005/0098349 | A1 | 5/2005 | Krueger | |
| 2006/0157282 | A1 | 7/2006 | Tilton | |
| 2006/0243493 | A1 * | 11/2006 | El-Rayes | E21B 4/02 175/107 |
| 2007/0007041 | A1 | 1/2007 | Krueger et al. | |
| 2008/0164062 | A1 * | 7/2008 | Brackin | E21B 44/005 175/24 |
| 2009/0041597 | A1 | 2/2009 | Brunner et al. | |
| 2009/0095528 | A1 * | 4/2009 | Hay | E21B 4/02 175/26 |
| 2011/0056686 | A1 | 3/2011 | Clem | |
| 2015/0068811 | A1 * | 3/2015 | Marchand | E21B 4/02 175/107 |
| 2015/0354280 | A1 * | 12/2015 | Downton | E21B 4/02 175/107 |

* cited by examiner

MITIGATING SWAB AND SURGE PISTON EFFECTS ACROSS A DRILLING MOTOR

TECHNICAL FIELD

This disclosure relates generally to equipment utilized and operations performed in conjunction with a subterranean well and, in one example described below, more particularly provides for mitigating swab and surge piston effects across a drilling motor.

BACKGROUND

Swab and surge effects can be caused when a tubular string (such as a drill string, casing string or completion string) is displaced in a wellbore. Such swab and surge effects can produce undesired pressure variations in the wellbore, possibly leading to fluid loss from the wellbore, influxes into the wellbore from a surrounding formation, fracturing of a formation, breakdown of a casing shoe, or other undesired consequences.

Therefore, it will be appreciated that improvements are continually needed in the art of mitigating swab and surge effects in wellbores.

DETAILED DESCRIPTION

Figure 1:
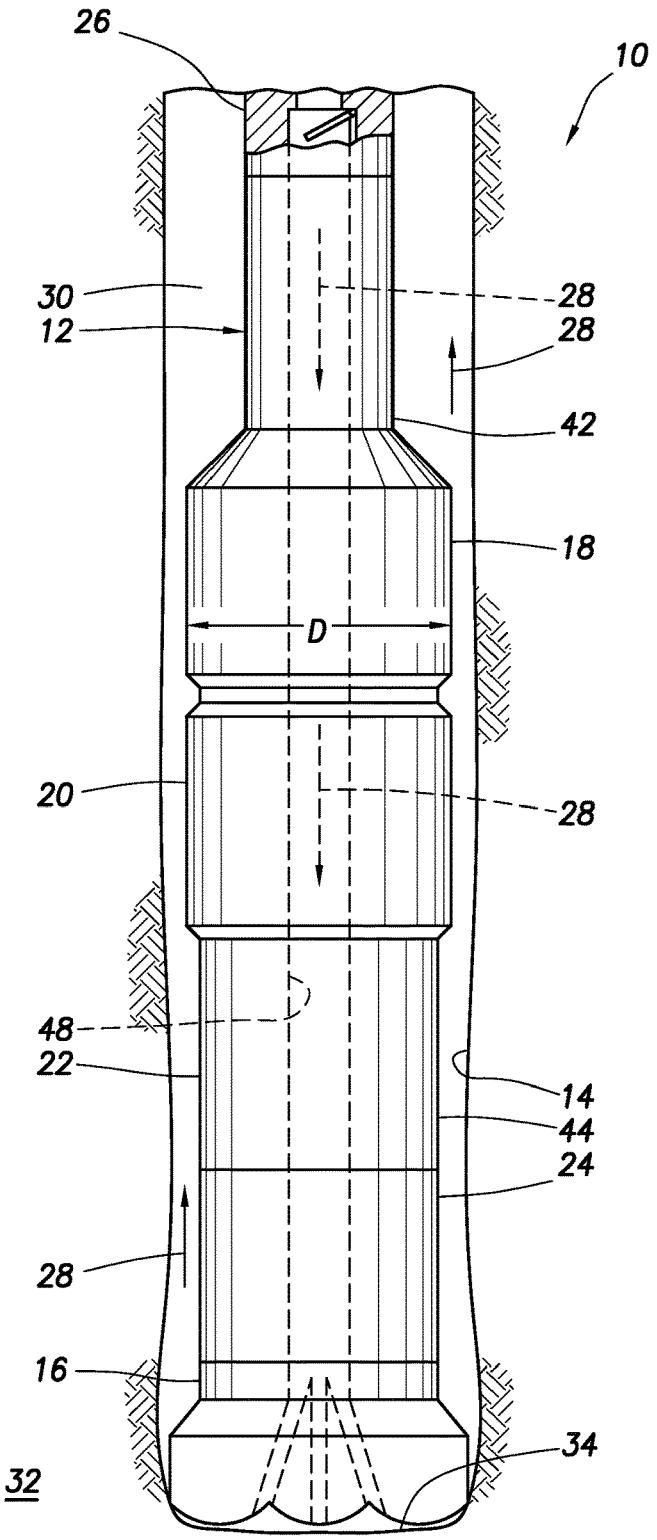
FIG. 1 is a representative partially cross-sectional view of a well system which can embody principles of this disclosure.

FIG. 1 is a representative partially cross-sectional view of a well system 10 which embodies apparatus principles of the disclosure and can be used to practice various method principles of this disclosure. However, it should be clearly understood that the well system 10 is merely one example embodiment as that, in practice, a wide variety of other examples are possible. Therefore, the scope of this disclosure is not limited at all to the details of the well system 10 and associated method(s) described herein and/or depicted in the drawings.

In the FIG. 1 example, a well tool string 12 is used to drill a wellbore 14. The well tool string 12 comprises a drill string, including a drill bit 16, one or more drill collars 18, a measurement-while-drilling (MWD) sensor and telemetry tool 20, a drilling motor 22 (such as, a positive displacement or Moineau-type motor, or a turbine), a steering tool 24 (such as a rotary steerable tool or a bent sub) and other drill string components. The drill bit 16, drill collars 18, MWD tool 20, drilling motor 22 and steering tool 24 may be collectively referred to as a bottom hole assembly (BHA).

A non-return valve 26 may be provided to allow flow of a drilling fluid 28 in only one direction through the drill string toward the drill bit 16. The drilling fluid 28 returns to surface via an annulus 30 formed radially between the string 12 and the wellbore 14.

Although the FIG. 1 example includes certain well tools and a particular arrangement of those well tools, it should be clearly understood that the scope of this disclosure is not limited to only the depicted well tools and/or combination or arrangement of well tools. Instead, the principles of this disclosure are applicable to many different examples in which mitigation of swab and/or surge effects is desired.

Figure 2:
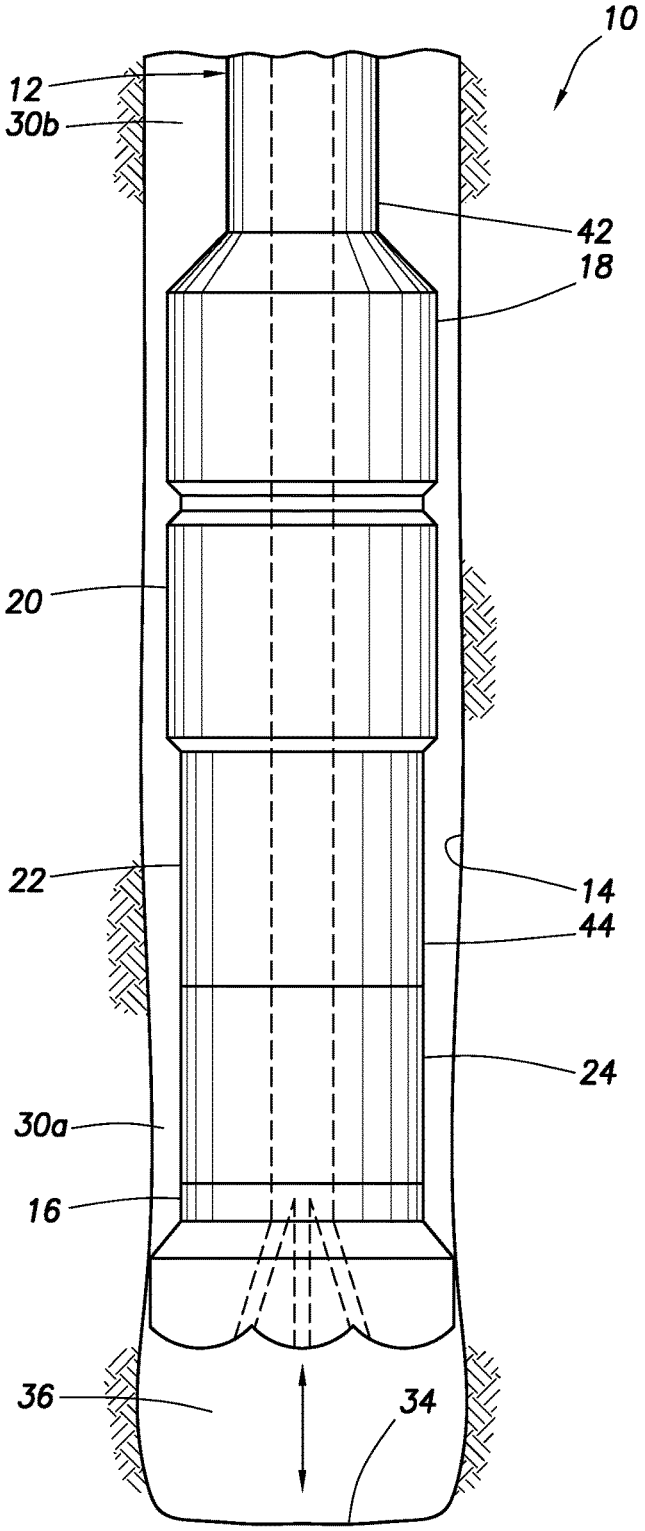
FIG. 2 is a representative partially cross-sectional view of the system of FIG. 1, with a well tool string being displaced in a wellbore.

With the drill bit 16 in contact with a bottom 34 of the wellbore 14, only relatively slow displacement of the string 12 downward (as viewed in FIG. 1) is permitted as the drill bit 16 cuts into a formation 32 penetrated by the wellbore. FIG. 2 is a representative partially cross-sectional view of the system of FIG. 1, with a well tool string being displaced in a wellbore. If the well tool string 12 is displaced rapidly upward or downward relative to the wellbore 14, as representatively depicted in FIG. 2, portions of the string having enlarged outer dimensions (e.g., larger outer diameters) will displace fluid in the wellbore 14 and cause swab and/or surge effects therein.

Such displacement of the string 12 can be the result of heave motion on a floating rig (not shown), tripping into or out of the wellbore 14, and other displacements of the string. In the FIG. 2 example, swab and surge effects in a bottom section 36 of the wellbore 14 are exacerbated as a distance between the BHA and the bottom 34 of the wellbore decreases.

Specifically, if the string 12 displaces downward (as viewed in FIG. 2) toward the bottom 34 of the wellbore 14, pressure in the bottom section 36 of the wellbore will increase, and pressure in a section 30*b* of the annulus 30 above the BHA will decrease, resulting in a pressure differential across the BHA. Conversely, if the string 12 displaces upward (as viewed in FIG. 2) away from the bottom 34 of the wellbore 14, pressure in the section 30*b* of the annulus 30 above the BHA can increase, and pressure in the section 36 of the wellbore will decrease, again resulting in a pressure differential across the BHA, but in an opposite direction. Pressure in a section 30*a* of the annulus 30 surrounding the BHA may increase or decrease as the string 12 displaces in each direction, depending on restrictions to flow in the annulus about the various well tools in the BHA.

It is desired, in the FIGS. 1 & 2 example, to mitigate potentially harmful pressure increases and/or decreases in the wellbore 14 by eliminating or at least reducing the pressure differentials across well tools (such as the BHA of FIGS. 1 & 2) which result from displacement of the string 12 in the wellbore. However, it should be appreciated that the bottom section 36 of the wellbore 14 is only one wellbore section which can experience pressure increases and/or decreases due to movement of the string 12, and the scope of this disclosure is not limited to mitigating undesired pressure variations in the wellbore below the drill bit 16.

Figure 3:
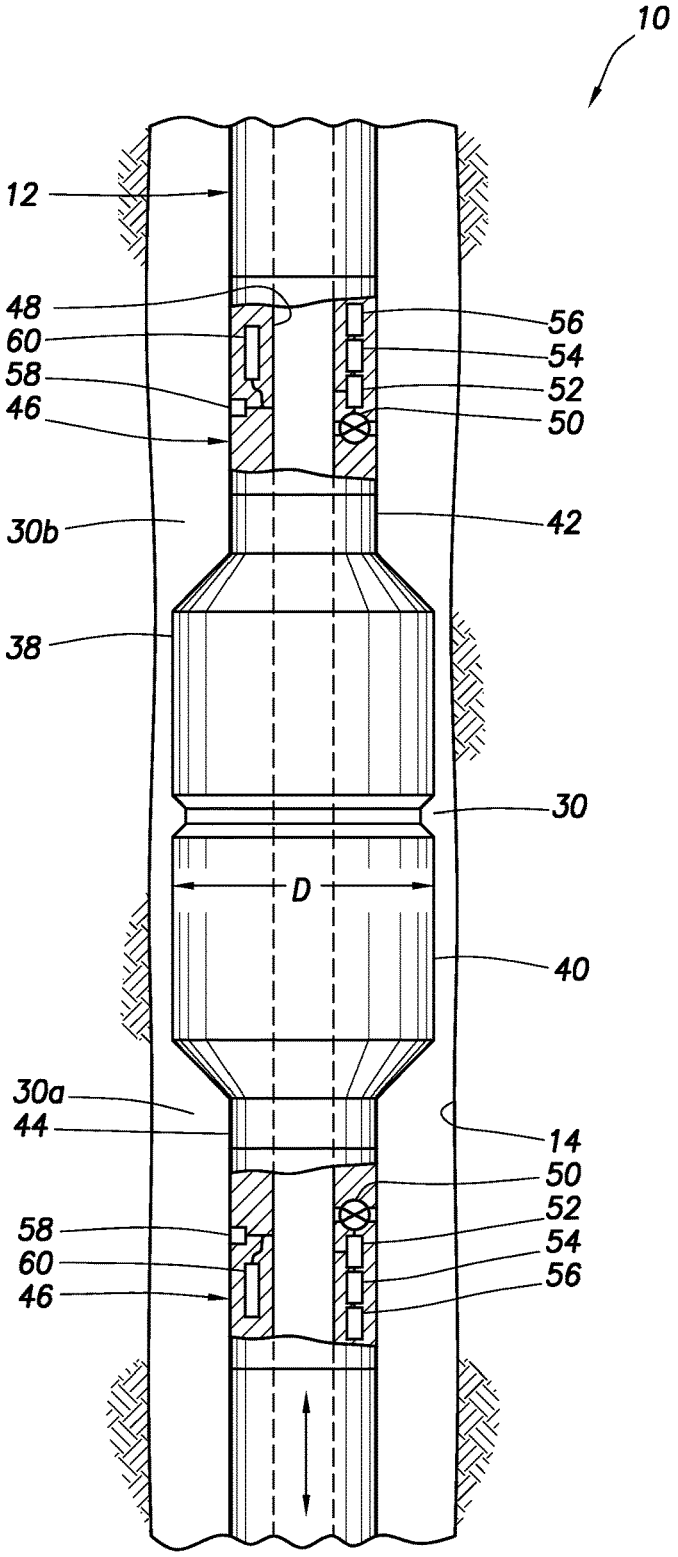
FIG. 3 is a representative partially cross-sectional view of another example of a well system.

FIG. 3 is a representative partially cross-sectional view of another example of a well system, in which the string 12 includes well tools 38, 40 connected in the string. The well tools 38, 40 have larger outer diameters, as compared to adjacent sections 42, 44, and so the enlarged outer diameters of the well tools act as an annular "piston" in the wellbore 14, with restricted flow in the annulus 30 about the well tools. Thus, a pressure differential can be created in the wellbore 14 (e.g., between the annulus sections 30*a,b*) by displacing the string 12 relative to the wellbore.

The well tools 38, 40 could be any type of well tools, for example, the drill bit 16, drill collars 18, MWD tool 20, drilling motor 22, steering tool 24, non-return valve 26, or any type of drilling, completion or cementing tool. The scope of this disclosure is not limited to use of any particular number, type or combination of well tools.

In the FIG. 3 well system 10, pressure balancing tools 46 are connected in the string 12 on opposite sides of the well tools 38, 40. The tools 46 provide selective fluid communication between each of the annulus 30*a,b* sections and a flow passage 48 extending longitudinally through the string 12. In this manner, pressure differentials between the annulus sections 30*a,b* due to displacement of the string 12 can be prevented or at least reduced.

Each of the tools 46 includes a flow control device 50 (e.g., a valve or choke) which opens and closes to respectively permit and prevent fluid communication between the flow passage 48 and the annulus 30 on an exterior of the string 12. Actuation of the device 50 is controlled by a processor 52, with memory 54 and a power supply 56 (such as batteries, a downhole generator, electrical conductors or fiber optics).

One or more sensors 58 detects one or more parameters indicative of movement of the string 12 relative to the wellbore 14. For example, pressure sensors 58 of the tools 46 can detect pressure in the annulus sections 30*a,b* and, thus, a pressure differential between the annulus sections which is due to movement of the string 12. Of course, a single pressure differential sensor could be used instead of separate sensors to detect pressures in separate sections of the wellbore 14.

An accelerometer can directly measure acceleration of the string 12, and an integrator can be used to determine velocity of the string. Thus, the scope of this disclosure is not limited to use of any particular type of sensor(s) used to measure a parameter indicative of the movement of the string 12 in the wellbore 14.

When the sensors 58, or any one or more of them, detect substantial movement of the string 12 sufficient to produce an undesired pressure increase and/or decrease in the wellbore 14, the flow control devices 50 can open, thereby providing fluid communication between the annulus sections 30*a,b* via the flow passage 48, and reducing or eliminating a pressure differential between the annulus sections. Opening of the flow control devices 50 can be synchronized by use of telemetry devices 60 (such as, devices capable of short hop acoustic or electromagnetic telemetry, or other types of wired or wireless telemetry).

In this manner, the opening and closing of the flow control devices 50 can be substantially simultaneous. If desired, actuation of a first flow control device 50 could be delayed, in order to allow for wireless transmission time and decoding to actuate a second flow control device 50, so that the flow control devices are actuated substantially simultaneously. If wired communication is used, simultaneous actuation may be achieved without the delay. Use of the telemetry devices 60 can also allow the number of sensors 58 to be reduced (e.g., a single accelerometer could be used to control actuation of multiple flow control devices 50).

In other examples, the flow control devices 50 may not be actuated synchronously. Thus, the scope of this disclosure is not limited to synchronous (or substantially synchronous) actuation of the flow control devices 50.

Note that it is not necessary for the sensors 58 to be contained in either or both of the tools 46. For example, if the MWD tool 20 includes an accelerometer and/or pressure sensor, those sensor(s) may be used instead for the sensors 58. The tools 46 may communicate with the MWD tool 20 via wired or wireless telemetry (e.g., short hop acoustic or electromagnetic telemetry).

Since MWD tools generally include a variety of sensors, those sensors can possibly be of use in controlling actuation of the pressure balancing tools 46 in other ways. For example, the MWD tool 20 can include a weight-on-bit and/or torque sensor 58 which measures compression and/or torque in the string 12.

The flow control devices 50 can be maintained closed when the weight-on-bit or torque sensor 58 measures compression or torque in the string 12 indicative of a bit-on-bottom condition or drilling ahead (in which case movement of the string 12 relative to the wellbore 14 should be insufficient to produce harmful pressure variations). In this manner, for example, accelerations measured by the sensor 58 during drilling (which accelerations may be quite large, but of relatively short duration, so that they do not cause excessive pressure variations in the wellbore 14) will preferably not cause the flow control devices 50 to open.

The processor 52 may be programmed to maintain the flow control devices 50 closed if rotation, compression and/or torque in the string 12 is above a predetermined threshold. The processor 52 may be programmed to only open the flow control devices 50 if acceleration, velocity or other measured displacement of the string 12 is above a predetermined value or duration threshold. However, the scope of this disclosure is not limited to any particular manner of controlling actuation of the flow control devices 50.

Although the pressure balancing tools 46 are depicted in FIG. 3 as being separate tools connected in the string 12, the components of the tools could instead be incorporated into the well tools 38, 40. Similarly, the components of the pressure balancing tools 46 could be incorporated into any of the well tools (e.g., drill bit 16, drill collars 18, MWD tool 20, drilling motor 22, steering tool 24, non-return valve 26) in the FIGS. 1 & 2 example, as well.

Although the pressure balancing tools 46 are depicted in FIG. 3 as including certain components (e.g., flow control device 50, processor 50, memory 54, power supply 56, sensors 58, telemetry device 60), it is not necessary for a pressure balancing tool to include any particular number, arrangement or combination of components. If multiple pressure balancing tools 46 are used, it is not necessary for each tool to include the same components. The scope of this disclosure is not limited to use of any particular pressure balancing tool 46 configuration(s).

Figure 4:
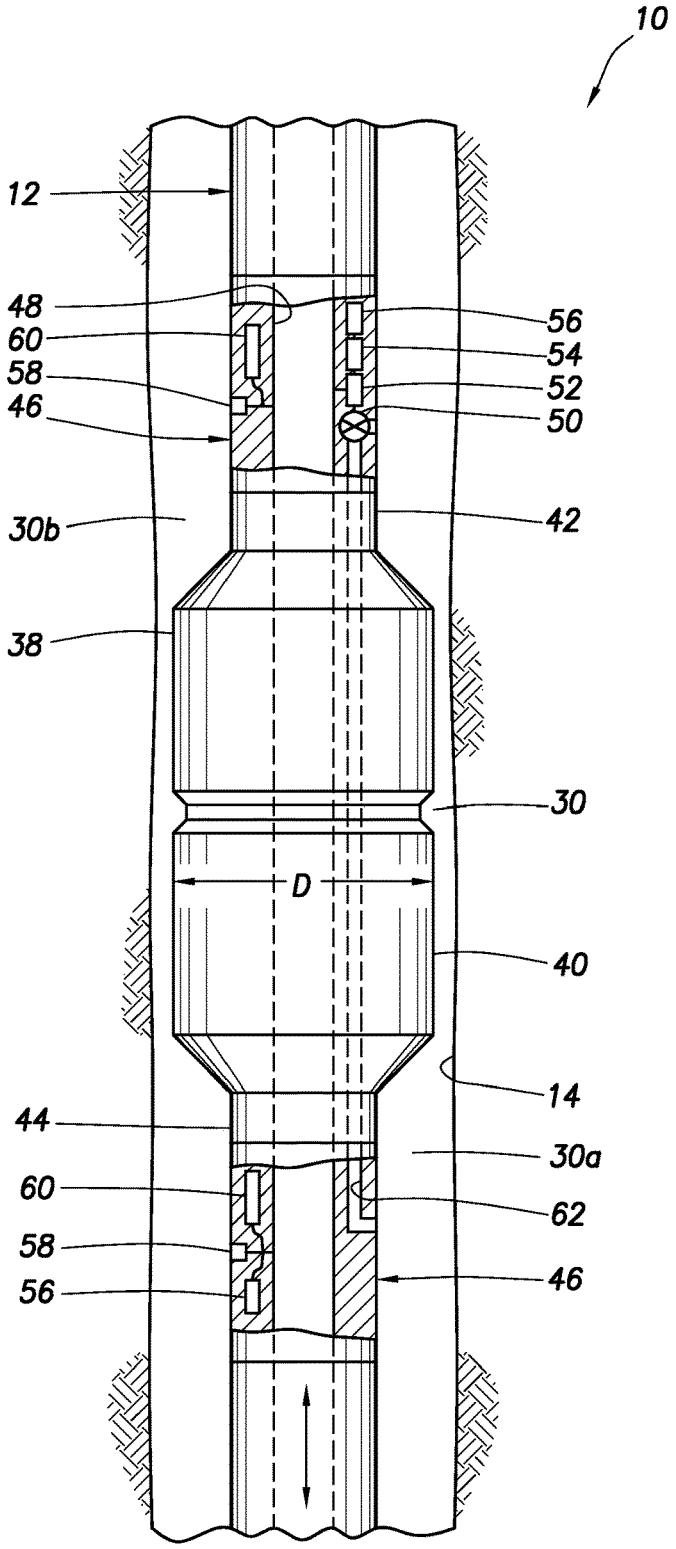
FIG. 4 is a representative partially cross-sectional view of yet another example of a well system.

FIG. 4 is a representative partially cross-sectional view of yet another example of a well system, in which the pressure balancing tools 46 are connected in the string 12 on opposite sides of the well tools 38, 40. However, in this example, the tools 46 are not configured the same, and the flow passage 48 is not used for providing fluid communication between the annulus sections 30*a,b*.

A separate bypass passage 62 extends longitudinally in the well tools 38, 40 for providing fluid communication between the annulus sections 30*a,b*. A single flow control device 50 in the upper pressure balancing tool 46 is used to control flow through the passage 62, in order to reduce or eliminate any pressure differentials between the annulus sections 30*a,b*.

The lower pressure balancing tool 46 does not include a flow control device, processor or memory in this example. Only the sensors 58, power supply 56 and telemetry device 60 are included in the lower tool 46. However, various configurations of the upper and lower tools 46 may be used, in keeping with the scope of this disclosure.

When the sensors 58 (or only one sensor, or any combination of sensors) detect that sufficient movement of the string 12 is occurring to cause undesired pressure increases and/or decreases in the wellbore 14, the flow control device 50 can be opened to prevent or relieve any pressure differential across the well tools 38, 40 by allowing flow between sections of the wellbore on opposite sides of the well tools 38, 40.

Note that, in the FIGS. 3 & 4 examples, two well tools 38, 40 have enlarged outer dimensions D in the string 12. However, in other examples, only one well tool, or any combination of well tools (e.g., the BHA of the FIGS. 1 & 2 example) may have pressure differentials created across them, due to movement of the string 12.

If the flow passage 48 is used for mitigating a pressure differential due to movement of the string 12 (as in the FIG. 3 example), then fluid 28 (see FIG. 1) will preferably be able to flow in either longitudinal direction through the flow passage between the wellbore sections (e.g., annulus sections 30*a,b* and/or wellbore bottom section 36), in order to prevent or relieve any pressure differential. However, if the drilling motor 22 is connected in the string 12 between the wellbore sections (e.g., if the drilling motor is one of the well tools 38, 40 in the FIG. 3 example), then such flow through the passage 48 could cause the drilling motor to rotate (with the rotation being forward or backward, depending on the fluid 28 flow direction).

Figure 5:
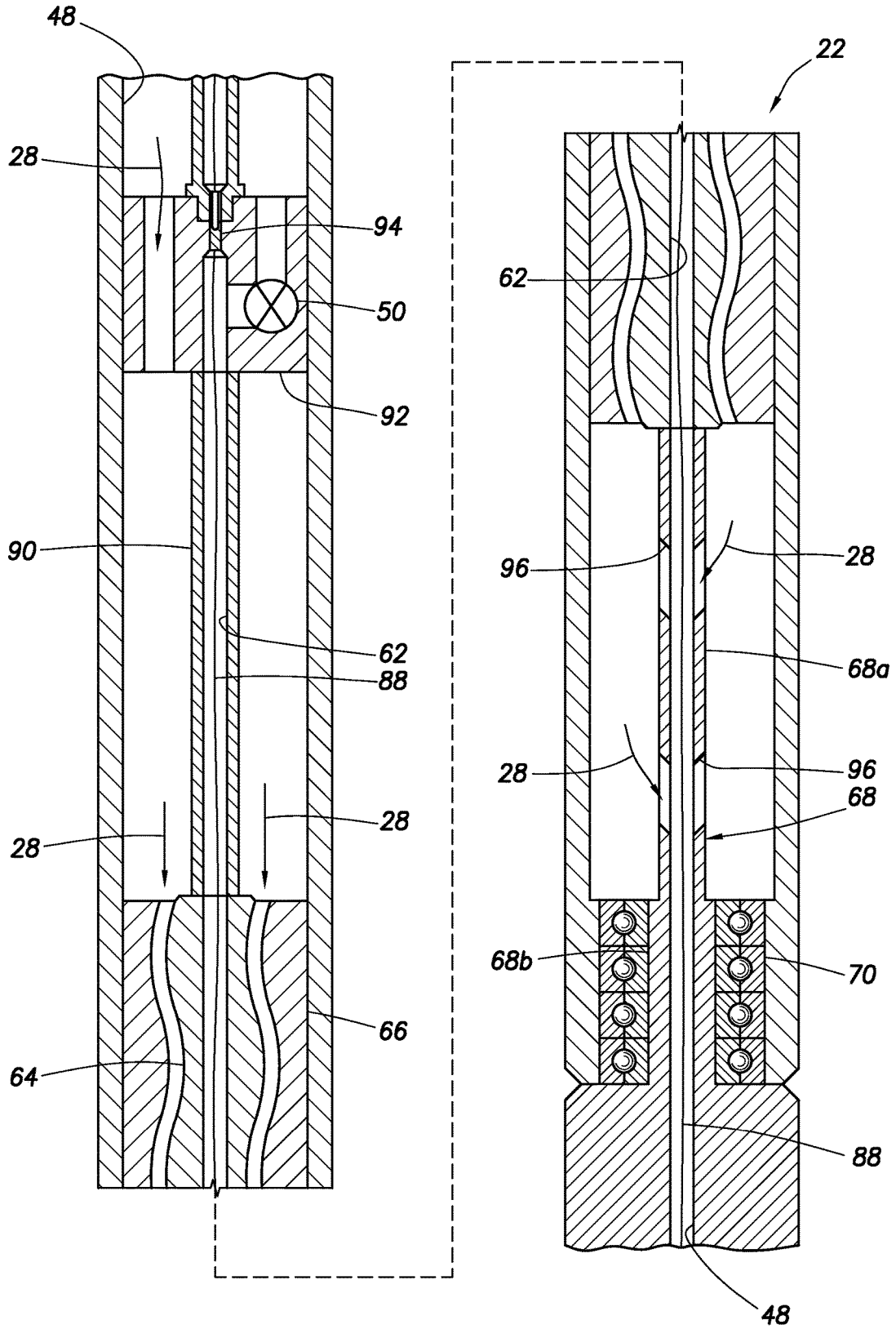
FIG. 5 is a representative cross-sectional view of a drilling motor which can embody the principles of this disclosure.

FIG. 5 is a representative cross-sectional view of a drilling motor which can embody the principles of this disclosure. In this example, the bypass passage 62 is incorporated into the drilling motor 22, so that the fluid 28 can flow through the drilling motor (in order to prevent or relieve any undesired pressure increases or decreases in the wellbore 14), without the fluid flow causing the drilling motor to rotate.

As depicted in FIG. 5, during normal drilling operations, the fluid 28 flows into an upper end of the drilling motor 22 via the flow passage 48, which extends longitudinally through the drilling motor. The drilling motor 22 rotates in response to flow of the fluid 28 through a progressive helical cavity between a rotor 64 and a stator 66.

Typically, both the rotor 64 and the stator 66 have helical lobes formed thereon, with the rotor having one less lobe than the stator. However, other configurations may be used in other examples.

Typically, the rotor 64 is surrounded by the stator 66, which is integrated into an outer housing of the drilling motor 22. However, in other examples, the rotor 64 could be external to the stator 66. Thus, the scope of this disclosure is not limited to any particular configuration of the rotor 64 and the stator 66.

The rotor 64 rotates in response to the flow of the fluid 28 through the progressive helical cavity between the rotor and the stator 66. A shaft 68 is connected to, and is rotated by, the rotor 64. Although not visible in FIG. 5, the shaft 68 is also connected to the drill bit 16 (e.g., via the steering tool 24 (see FIG. 1), if the steering tool is used), so that the drill bit is rotated when the rotor 64 rotates.

A section 68*a* of the shaft 68 is flexible, so that the rotor 64 can "wobble" as it rotates. A lower section 68*b* of the shaft 68 is received in a bearing stack and seal assembly 70 at a lower end of the drilling motor 22. Note that, if a turbine-type drilling motor is used, the rotor 64 preferably does not "wobble" as it rotates, and so the section 68*a* of the shaft 68 would not necessarily be flexible in that case.

In the FIG. 5 example, the shaft 68 and rotor 64 have the bypass passage 62 extending longitudinally therethrough. The bypass passage 62 allows the fluid 28 to flow longitudinally through the drilling motor 22, without the fluid necessarily flowing through the progressive cavity between the rotor 64 and stator 66.

The passage 62 also accommodates a line 88 (such as, an electrical or optical line) for transmitting power, data and/or commands through the drilling motor 22. For example, the line 88 may extend between the MWD tool 20 above the drilling motor 22 and the steering tool 24 below the drilling motor, in order to provide power to operate the steering tool, and to provide for communication between the MWD and steering tools.

The passage 62 extends upwardly from the rotor 64 through another flexible shaft 90 to a bulkhead 92. The flexible shaft 90 rotates with the rotor 64. A rotary connector 94 is provided in the bulkhead 92 for connecting the line 88 to non-rotating components above.

The bulkhead 92 also accommodates the flow control device 50. In this example, the flow control device 50 provides selective fluid communication between the bypass passage 62 and the passage 48 above the rotor 64 and stator 66. The processor 52, memory 54, power supply 56, sensors 58 and/or telemetry device 60 may also be included in the bulkhead 92, or may be otherwise positioned in the drilling motor 22, or these components may not be used in the drilling motor if the flow control device 50 is otherwise controlled (e.g., using a processor and associated components in another pressure balancing tool 46).

During normal drilling operations, the flow control device 50 is closed, so that fluid 28 flowed downwardly through the passage 48 is forced to flow through the progressive cavity between the rotor 64 and the stator 66. This flow of the fluid 28 causes the rotor 64 to rotate, thereby rotating the shaft 68 and the drill bit 16 below.

After flowing between the rotor 64 and stator 66, the fluid 28 flows into the shaft 68 via openings 96, and then downward through the passage 48 in the shaft to the drill bit 16. In this manner, the drill bit 16 is rotated by the drilling motor 22, and is provided with the flow of the fluid 28 (for example, to lubricate and cool the bit, and to circulate drill cuttings out of the wellbore 14).

Figure 6:
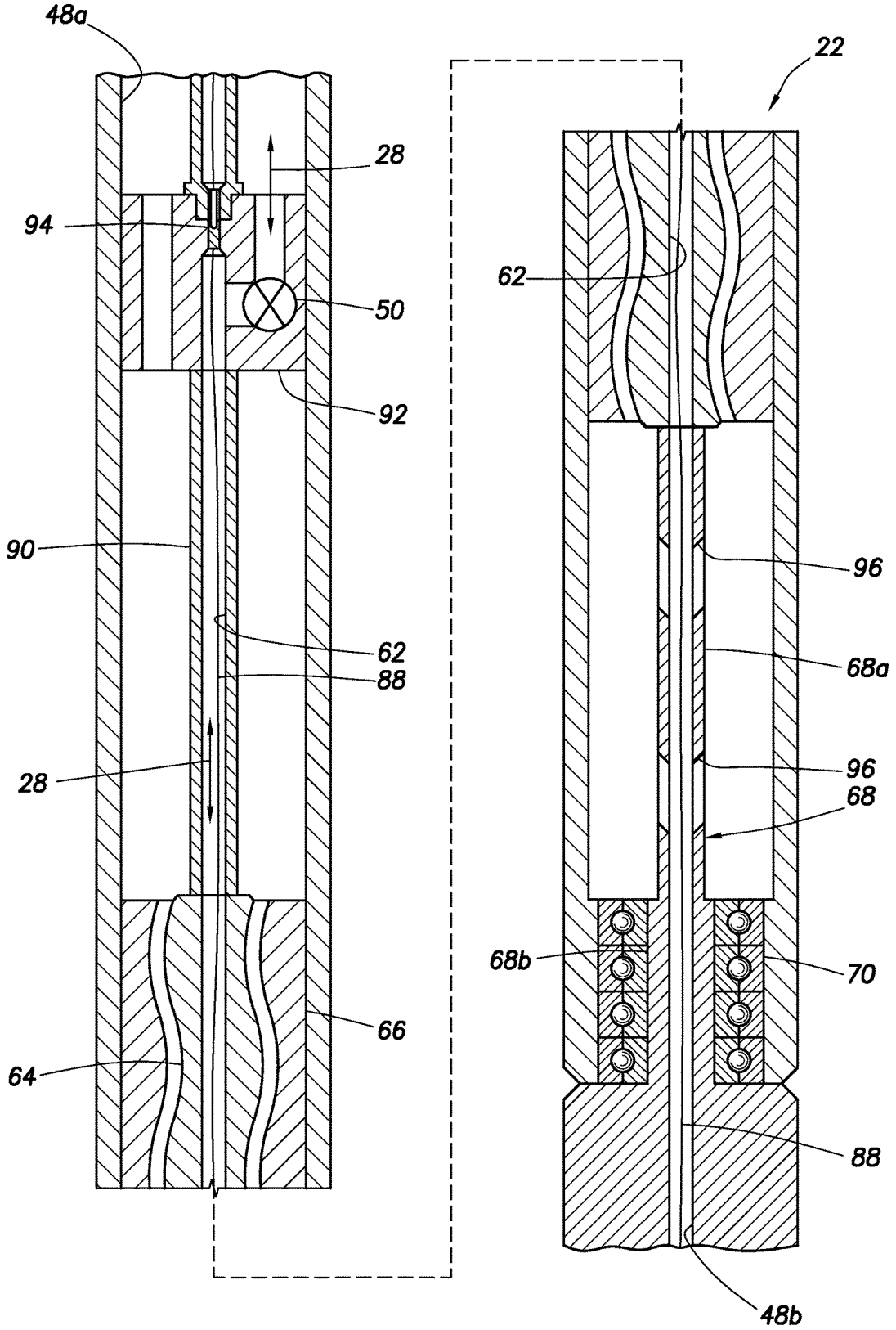
FIG. 6 is a representative cross-sectional view of the drilling motor with flow permitted through a flow passage therein.

FIG. 6 is a representative cross-sectional view of the drilling motor with flow permitted through a flow passage therein. In FIG. 6, the drilling motor 22 is representatively illustrated after the flow control device 50 has been opened. The flow control device 50 is opened in this example in response to the sensors 58 outputs indicating that the drill string 12 movement is sufficient to cause undesired pressure increases and/or decreases in the wellbore 14, as described above.

With the flow control device 50 open (or partially open if a choke is used), the fluid 28 can flow in either direction through the bypass passage 62 between upper and lower sections 48*a,b* of the flow passage 48 on opposite sides of the drilling motor 22. This flow of fluid 28 through the bypass passage 62 will not cause the rotor 64 to rotate, either forward or backward.

Figure 7:
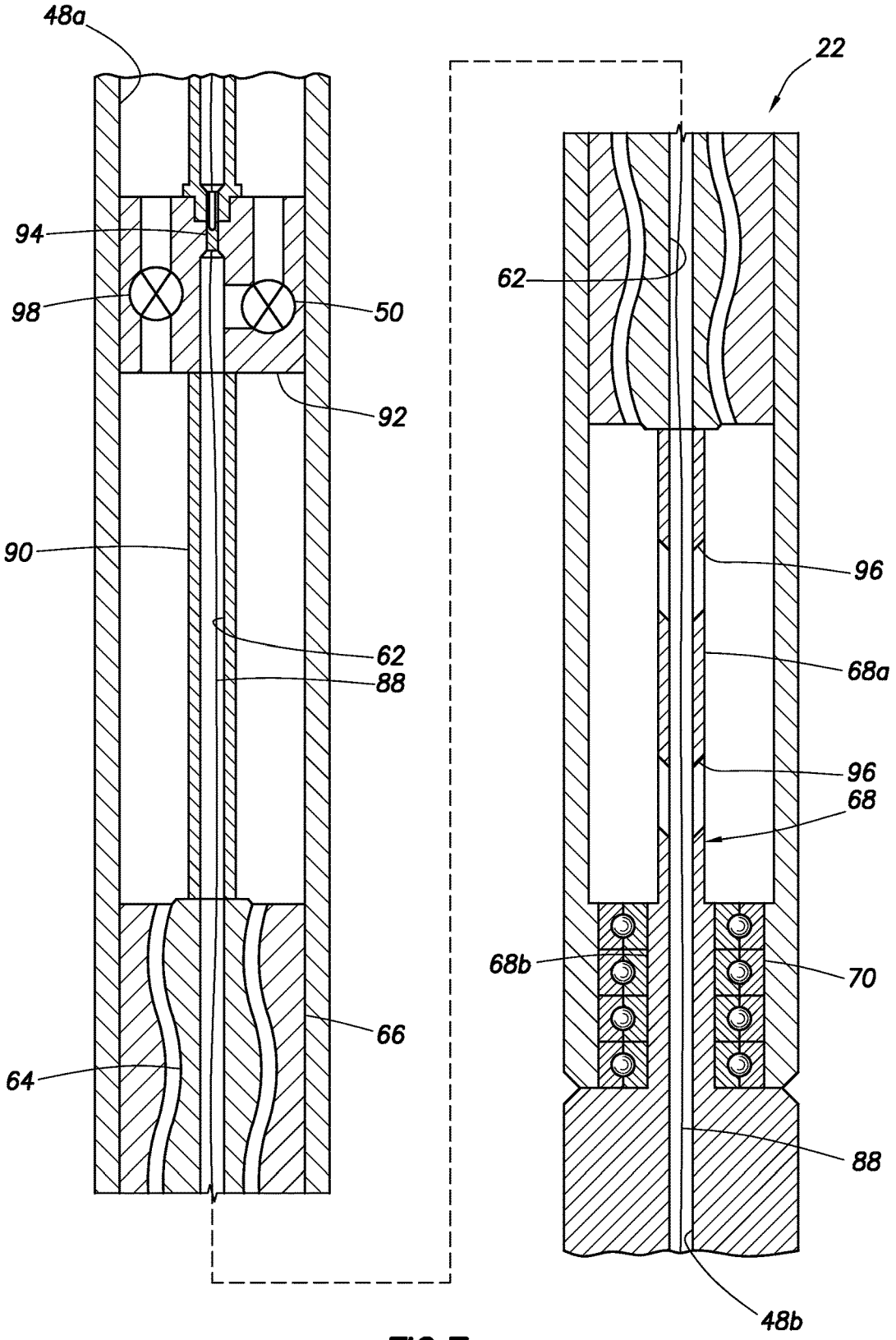
FIG. 7 is a representative cross-sectional view of another example of the drilling motor.

FIG. 7 is a representative cross-sectional view of another example of the drilling motor. If it is desired to positively prevent flow of fluid 28 between the rotor 64 and stator 66 when the flow control device 50 is opened, the configuration representatively illustrated in FIG. 7 may be used. In the FIG. 7 example, another flow control device 98 is used to selectively permit and prevent flow between the upper flow passage section 48*a* and the space between the rotor 64 and stator 66.

The device 98 can be closed when the device 50 is opened, and vice versa. Instead of two devices 50, 98, a single three-way valve could be used. Thus, it will be appreciated that the scope of this disclosure is not limited to any particular number, combination or arrangement of components in the drilling motor 22.

Although in the FIGS. 5-7 examples, the drilling motor 22 is depicted as comprising a Moineau-type positive displacement motor, it will be appreciated that the principles described above can also be used if the drilling motor is a turbine-type drilling motor (or another type of drilling motor). Thus, the scope of this disclosure is not limited to use of any particular type of drilling motor.

Figure 8:
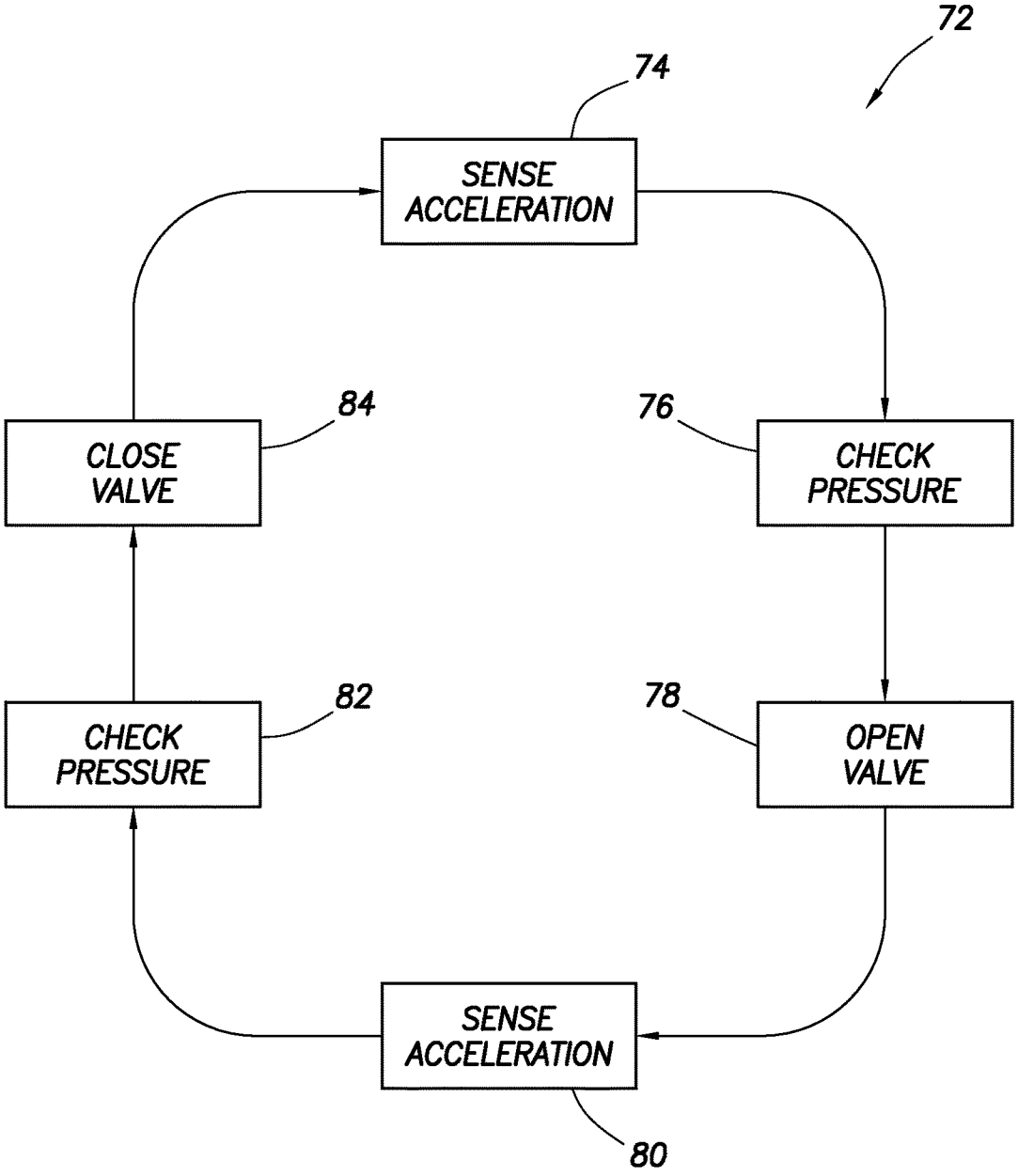
FIG. 8 is a representative flowchart for an example method of mitigating swab and surge effects.

FIG. 8 is a representative flowchart for an example method of mitigating swab and surge effects. In FIG. 8, a flowchart for a method 72 of mitigating undesired pressure variations in the wellbore 14 is representatively illustrated. In this example, the sensors 58 comprise both acceleration and pressure sensors, which substantially continuously provide outputs to the processor 52 for determining whether the flow control device 50 should be opened or closed. In other examples, rotation, compression and/or torque sensors may be used in addition to, or instead of, the acceleration and pressure sensors.

In step 74, acceleration is sensed by the acceleration sensor 58. In step 76, pressure is sensed by the pressure sensor 58. If the output of either of these sensors 58 indicates that displacement of the string 12 is causing, or will cause, undesired pressure increases and/or decreases in the wellbore 14, the flow control device 50 is opened in step 78. This prevents, relieves or at least reduces pressure differentials across well tools in the string 12.

If a rotation sensor (e.g., a gyroscope in the MWD tool 20) indicates that rotation of the string 12 is less than a predetermined level, and accelerometer and/or pressure sensors indicate an undesired pressure condition is occurring or will be produced, the flow control device 50 can be opened. Weight on bit and/or torque sensors (for example, in the MWD tool 20) could be used to ensure that the string 12 is not being used to drill the wellbore 14 when the flow control device 50 is opened.

That is, it is preferred that the flow control device 50 not be opened if the string 12 is being used to drill the wellbore 14. Various types of sensors (e.g., a gyroscope or other rotation sensor, a weight on bit sensor, a torque sensor), in combination with appropriate logic programming, may be used to determine whether drilling is currently being performed.

If a downhole electrical generator is included in the string 12 to generate electrical power in response to flow of the drilling fluid 28 through the string, an output of the generator may provide an indication of whether a drilling ahead operation is occurring. For example, if a revolutions per minute, voltage output or current output of the generator indicates that the fluid 28 is circulating through the string 12, this can be an indication that a drilling ahead operation is occurring (although, in some situations, fluid may be circulated through the string while not drilling ahead).

In steps 80 and 82, acceleration and pressure are again sensed by the sensors 58. If the outputs of the sensors 58 do not indicate that displacement of the string 12 is causing, or will cause, undesired pressure increases and/or decreases in the wellbore 14, the flow control device 50 is closed in step 84. This allows normal operations (e.g., drilling operations, stimulation or completion operations, or cementing operations) to proceed without the flow control device 50 being open. The flow control device 50 can be prevented from opening if the sensors 58 detect rotation, compression or torque in the string 12, as described above.

Although FIG. 8 depicts certain steps 74, 76, 78, 80, 82, 84 as being performed in a certain order, this order of steps is not necessary in keeping with the scope of this disclosure. Instead, the FIG. 8 flowchart is intended to convey the concept that the outputs of the sensors 58 are substantially continuously (or at least regularly or periodically) received by the processor 52 for a determination of whether the flow control device 50 should be opened or closed.

Note that, if a choke is used for the flow control device 50, then opening or closing the flow control device can include partially opening or partially closing the flow control device. Thus, fluid communication between wellbore sections may be increased or decreased via the flow control device 50, without such fluid communication through the flow control device being completely permitted or prevented.

It may now be fully appreciated that the above disclosure provides significant advancements to the art of mitigating swab and surge effects in wellbores. In examples described above, undesired pressure increases and decreases in the wellbore 14 can be mitigated by use of one or more flow control devices 50 that reduce or prevent pressure differentials across well tools caused by displacement of a well tool string 12 in the wellbore.

A method 72 of mitigating undesired pressure variations in a wellbore 14 is provided to the art by the above disclosure. In one example, the method 72 can comprise increasing flow of fluid 28 between sections of the wellbore 14 (e.g., annulus sections 30*a,b*, and/or the bottom section 36 of the wellbore), thereby mitigating a pressure differential between the wellbore sections due to movement of a drill string 12 in the wellbore 14, and the fluid 28 flowing between the wellbore sections via a bypass passage 62 extending through a drilling motor 22.

The bypass passage 62 may extend through a rotor 64 and/or a shaft 68 of the drilling motor 22.

The method can include sensing at least one parameter indicative of the movement of the drill string 12, and increasing flow through at least one flow control device 50 in response to the sensing, thereby providing fluid communication between the wellbore sections via the bypass passage 62.

The increasing of flow through the flow control device 50 may be performed when the parameter exceeds a threshold level. The parameter could comprise acceleration of the drill string 12. The parameter could comprise the pressure differential between the wellbore sections.

The increasing of flow through the flow control device 50 may be prevented if a parameter indicates that a drilling ahead operation is occurring. The parameter could comprise rotation, compression and/or torque in the drill string 12. The parameter could comprise an output of a downhole generator and/or flow of the fluid 28 through the string 12.

The fluid 28 flowing step may be performed without flowing the fluid 28 between a rotor 64 and a stator 66 of the drilling motor 22.

The bypass passage 62 can be in fluid communication with a flow passage 48 extending longitudinally through the drill string. The bypass passage 62 may provide selective fluid communication between sections 48*a,b* of the flow passage 48 on opposite sides of a rotor 64 of the drilling motor 22.

A drill string 12 is also provided to the art by the above disclosure. In one example, the drill string 12 can include a drilling motor 22 connected in the drill string 12, a bypass passage 62 in the drilling motor 22, a sensor 58, and at least one flow control device 50 configured to selectively increase and decrease fluid communication between opposite ends of the drilling motor 22 via the bypass passage 62, in response to an output of the sensor 58 indicative of movement of the drill string 12.

The bypass passage 62 preferably does not extend between a rotor 64 and a stator 66 of the drilling motor 22.

The sensor 58 may sense a pressure differential across the drilling motor 22. The sensor 58 may sense acceleration of the drill string 12.

The flow control device 50 can decrease flow through the bypass passage 62 in response to rotation, compression and/or torque in the drill string 12.

Flow through the bypass passage 62 may be increased in response to the sensor 58 output being indicative of a predetermined level of acceleration of the drill string 12.

Flow through the bypass passage 62 may be increased in response to the sensor 58 output being indicative of a predetermined level of pressure differential.

The method 72 can include synchronizing the actuation of multiple flow control devices 50 via telemetry. Such wired or wireless telemetry may be initiated from the surface, and/or from downhole control systems.

Preferably, the flow control devices 50 provide indications of their positions/configurations (e.g., open or closed). Such indications may be transmitted to a remote location (such as, to a control system at the earth's surface). Based on these indications, additional control could be exercised over the various tools in the string 12.

Another example of a method 72 of mitigating undesired pressure variations in a wellbore 14 due to movement of a drill string 12 can comprise selectively decreasing and increasing fluid communication between sections of the wellbore 14 (e.g., annulus sections 30*a,b*, and/or the bottom section 36 of the wellbore) on opposite sides of a drilling motor 22 in the drill string 12, the fluid communication being increased in response to detecting a threshold movement of the drill string 12 relative to the wellbore 14.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal or vertical, and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower") are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus or device is described as "including" a certain feature or element, the system, method, apparatus or device can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of mitigating pressure variations in a wellbore, the method comprising:

opening a bypass passage extending through a drilling motor to fluidly couple a first section of an annulus external to the drilling motor and above the drilling motor to a second section of the annulus below the drilling motor in response to movement of a drill string in the wellbore; and flowing a fluid through the bypass passage.

2. The method of claim 1, wherein the bypass passage extends through a rotor of the drilling motor.

3. The method of claim 1, further comprising:

sensing at least one parameter indicative of the movement of the drill string; and increasing flow through at least one flow control device in response to the sensing, thereby increasing fluid communication between the first section and the second section via the bypass passage.

4. The method of claim 3, wherein the flow increasing is performed when the at least one parameter exceeds a threshold level.

5. The method of claim 3, wherein the at least one parameter comprises acceleration of the drill tool string.

6. The method of claim 3, wherein the at least one parameter comprises the pressure differential between the first section and the second section.

7. The method of claim 1, wherein the fluid flowing is performed without flowing the fluid between a rotor and a stator of the drilling motor.

8. The method of claim 1, wherein the bypass passage is in fluid communication with a flow passage extending longitudinally through the drill string.

9. The method of claim 8, wherein the bypass passage provides selective fluid communication between sections of the flow passage on opposite sides of a rotor of the drilling motor.

10. The method of claim 1, wherein the bypass passage extends through a shaft of the drilling motor.

11. A drill string, comprising:

a drilling motor connectable to the drill string;

a bypass passage in the drilling motor that fluidly couples a first area outside of the drill string on one side of the drilling motor with a second area outside the drill string on the other side of the drilling motor;

a sensor; and at least one flow control device configured to selectively increase and decrease fluid communication between the first area and the second area via the bypass passage, in response to an output of the sensor indicative of movement of the drill string.

12. The drill string of claim 11, wherein the bypass passage extends through a rotor of the drilling motor.

13. The drill string of claim 11, wherein the bypass passage extends through a shaft of the drilling motor.

14. The drill string of claim 11, wherein the bypass passage does not extend between a rotor and a stator of the drilling motor.

15. The drill string of claim 11, wherein the sensor senses a pressure differential across the drilling motor.

16. The drill string of claim 11, wherein the s senses acceleration of the drill string.

17. The drill string of claim 11, wherein the flow control device is configured to decrease fluid communication between the first area and the second area in response to at least one of rotation, torque and compression in the drill string.

18. The drill string of claim 11, wherein the flow control device is configured to decrease fluid communication between the first area and the second area in response to an indication of drilling ahead.

19. The drill string of claim 11, wherein the flow control device is configured to increase fluid communication between the first area and the second area in response to the sensor output being indicative of a predetermined level of acceleration of the drill string.

20. The drill string of claim 11, wherein the flow control device is configured to increase fluid communication between the first area and the second area in response to the sensor output being indicative of a predetermined level of pressure differential.

21. A method of mitigating pressure variations in a wellbore due to movement of a drill string, the method comprising:

selectively preventing and permitting fluid communication between a first section of an annulus external to the drilling motor and above a drilling motor and a second section of the annulus below the drilling motor in the drill string via a bypass passage, the fluid communication being permitted in response to detecting a threshold movement of the drill string relative to the wellbore.

22. The method of claim 21, wherein the bypass passage is in the drilling motor.

23. The method of claim 22, wherein the bypass passage extends through a rotor of the drilling motor.

24. The method of claim 22, wherein the bypass passage extends through a shaft of the drilling motor.

25. The method of claim 21, wherein the threshold movement comprises a predetermined level of acceleration of the drill string.

26. The method of claim 21, wherein the threshold movement comprises sufficient movement of the drill string to cause a predetermined level of pressure differential across the drilling motor.

27. The method of claim 21, wherein the drill string includes at least one sensor which senses a pressure differential between the first section and the second section.

28. The method of claim 21, wherein the fluid communication is prevented in response to detecting at least one of rotation, torque and compression in the drill string.

29. The method of claim 21, wherein the fluid communication is prevented in response to detecting drilling of the wellbore.

* * * * *